United States Patent [19]

Goldfarb et al.

[11] Patent Number: 4,526,554

[45] **Date of Patent: * Jul. 2, 1985**

[54] TOY MOTORCYCLE AND LAUNCHER APPARATUS

[75] Inventors: Adolph E. Goldfarb, 4614 Monarca Dr., Tarzana, Calif. 91356; Delmar K. Everitt, Woodland Hills, Calif.

[73] Assignee: Adolph E. Goldfarb, Westlake Village, Calif.

[ * ] Notice: The portion of the term of this patent subsequent to Dec. 7, 1999 has been disclaimed.

[21] Appl. No.: 347,453

[22] Filed: Feb. 10, 1982

Related U.S. Application Data

[63] Continuation-in-part of Ser. No. 233,825, Feb. 12, 1981, Pat. No. 4,363,186.

[51] Int. Cl.[3] ..... A63H 29/00

[52] U.S. Cl. ..... 446/429; 446/440

[58] Field of Search ..... 46/206, 209, 202, 201, 46/72

[56] References Cited

U.S. PATENT DOCUMENTS

| | | | |
|---|---|---|---|
| 1,322,217 | 11/1919 | Anderson | 46/72 |
| 3,229,414 | 1/1966 | Bross | 46/206 X |
| 3,621,607 | 11/1971 | Morrison et al. | 46/206 |
| 3,789,540 | 2/1974 | Convertine et al. | 46/209 X |
| 3,886,682 | 6/1975 | Ieda et al. | 46/209 X |
| 4,043,556 | 8/1977 | Lappa | 46/206 X |
| 4,363,186 | 12/1982 | Goldfarb et al. | 46/209 |

*Primary Examiner*—M. Yu

*Attorney, Agent, or Firm*—Romney Golant Martin & Ashen

[57] ABSTRACT

Toy motorcycle play apparatus comprising a toy motorcycle having an energy-storing drive-train mechanism, and a launcher for imparting energy to the mechanism and then releasing the motorcycle for forward movement. The motorcycle comprises aligned rotatable front and rear ground-engaging wheels and an intermediate flywheel, all rotatable about horizontal transverse axes. The energy-storing drive-train mechanism is formed by the flywheel, one of the wheels, and a gear train between them which reduces speed and increases power and duration of rotation at that drive wheel. In operation, the motorcycle is powered by the flywheel, which also serves to maintain it upright by gyroscopic action as it moves forwardly. The launcher holds the motorcycle in the desired upright orientation with the drive wheel elevated so that it can rotate freely while energy is being stored in the flywheel. Then the motorcycle is released, the drive wheel is allowed to engage the launcher platform and propel the motorcycle forwardly. In a hand-powered version, a device such as a toothed rack may be pulled by the user to impart energy to the flywheel; then the user may selectively lower and release the motorcycle.

17 Claims, 18 Drawing Figures

TOY MOTORCYCLE AND LAUNCHER APPARATUS

RELATED APPLICATIONS

This application is a continuation-in-part of U.S. application Ser. No. 233,825 filed Feb. 12, 1981, and issued Dec. 14, 1982, as U.S. Pat. No. 4,363,186.

FIELD OF INVENTION

Toy vehicles and launchers therefore, particularly toy vehicles having an energy-storing drive mechanism.

BACKGROUND OF INVENTION

Toy vehicles with energy-storing drive mechanisms are very popular. Typically one or more ground engaging drive wheels is fixed or geared to a flywheel on the vehicle. The user may grasp the vehicle in his or her hand and repeatedly run it along the ground to impart rotation to the drive wheel, which in turn imparts rotation to the flywheel. Thus, the momentum of the flywheel stores energy so that when the user places the vehicle on the ground, the energy is transmitted to the drive wheel to power the vehicle forwardly. Various launching devices been used for such toy vehicles.

U.S. Pat. No. 3,471,963 to Tomiyama, simulates the manual operation described above by holding a rear drive wheel of a toy 4-wheel car against a motor-powered rotating drum to impart energy to a friction motor. When the wheels are going fast enough, the car overcomes stop means and moves forwardly. The car is supported on four wheels and is not gyroscopically balanced as it moves.

U.S. Pat. No. 3,803,756 to Strongin discloses a launcher which holds a toy car with its combination rear flywheel/drive wheel off the ground while energy is imparted from a motor to that flywheel/drive wheel by means of a releasable coupling between the end of the shaft of the flywheel/drive wheel and the shaft of the motor. Then the coupling is disengaged by transverse movement and the car is lowered, permitting the car to move forwardly, balanced on its two front wheels and its single rear flywheel/drive wheel.

The German Pat. No. 1,029,719 shows a toy motorcycle having aligned front and rear wheels, but balanced by a pair of support wheels each positioned at one side of the motorcycle. This toy motorcycle includes a flywheel geared to a rear drive wheel. The flywheel is engaged by motor-operated power-transmitting means on a launcher to impart energy to the flywheel. However the flywheel is on a movable vertical shaft that is depressed to couple it with the power-transmitting means, and it appears also to disengage from the rear drive wheel while in this position. The flywheel shaft then moves back upwardly to disengage from the power transmitting means and to re-engage with the drive wheel, and the motorcycle moves forwardly.

U.S. Pat. No. 3,789,540 to Convertine discloses a 4-wheel toy car and launcher. The car is elevated off the ground while an air pump imparts energy to a combination turbine/flywheel that is geared to the drive wheels of the car. The car is then lowered and released for forward movement.

U.S. Pat. No. 3,621,607 to Morrison discloses a gyroscopically balanced toy vehicle with a launcher. The toy vehicle has only a single wheel which combines the drive wheel and the flywheel; thus, there is no lowering of speed or increasing of power and duration of rotation of the drive wheel with regard to the flywheel.

U.S. Pat. No. 2,788,613 to Gelfand discloses a launcher for a 4-wheeled toy car having an inertia-motor. A manually rotatable crank is coupled to and imparts rotation to a shaft of the inertia motor. When enough energy is imparted, the user releases a separate latch, and a spring in the coupling arrangement urges the toy car forwardly and off of elevating supports on the launcher so that the rotating drive wheels of the car reengage the ground.

U.S. Pat. No. 3,886,682 to Ieda et al, discloses a hand crank powered launcher for a toy motorcycle with an inertia motor. Side projections on the motorcycle are received in fixed slots in the launcher to elevate the motorcycle rear drive wheel while rotation is being imparted to it through a gear train on the launcher. When input is stopped, the motorcycle automatically moves forward, the projections move out of the fixed slots and the drive wheel is lowered.

SUMMARY OF DISCLOSURE

The presently preferred and illustrated form of the invention contemplates a two-wheeled gyroscopically-balanced toy vehicle and an associated launcher. The illustrated toy vehicle is in the form of a toy motorcycle having a flywheel for storing rotational energy. The flywheel is coupled to a rear drive wheel of the vehicle, as by a gear train which reduces speed while increasing power and duration of rotation to the drive wheel. The launcher has a platform and holds the motorcycle in the desired orientation, upright and with the drive wheel elevated off the platform, imparts energy to the flywheel, and then lowers and releases the motorcycle for forward movement under its own power. More particularly, when the motorcycle is lowered and released, the drive wheel engages the platform to propel the motorcycle forwardly, while the flywheel continues to rotate to provide power to the drive wheel and also acts to maintain the motorcycle upright in its travel by virtue of gyroscopic action. One illustrated embodiment comprises a motor-driven power-transmitting drum mounted on a movable arm pivotally supported on the launcher. By moving the arm, the outer edge of the rotating power-transmitting drum is moved against the outer edge of the flywheel on the motorcycle to impart rotation to the flywheel. Then when the arm is again moved in the opposite direction, the power-transmitting drum disengages and the motorcycle is lowered and released. In a manually powered version, the toy motorcycle is held by the launcher while the user imparts energy to the flywheel, as by pulling a rack engaged with a gear on the drive wheel. When the rack disengages, the toy motorcycle is thereby automatically permitted to move to where it is released from the launcher and the drive wheel engaged the launcher platform to propel the motorcycle forwardly.

In another manually powered version the release mechanism is separately and selectively operable to lower and release the toy motorcycle at such time as the user chooses.

IN THE DRAWINGS

DETAILED DESCRIPTION OF THE EMBODIMENTS

Figure 6:
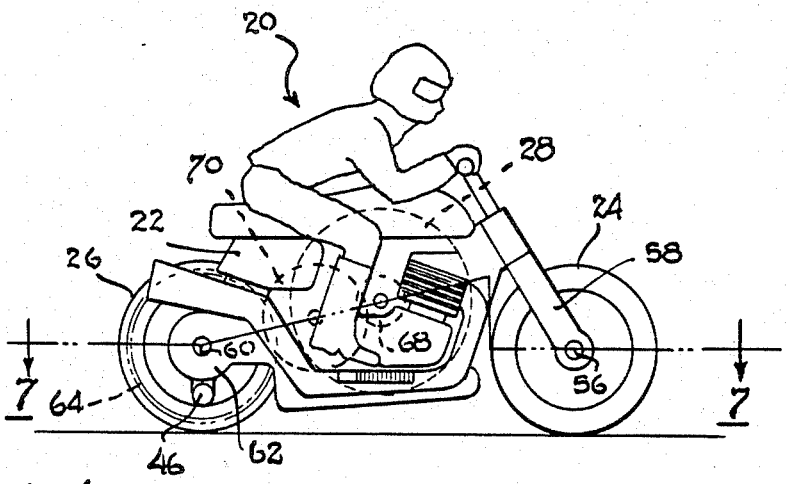
FIG. 6 is a side elevational view of a toy motorcycle for use with the launcher.
Figure 5:
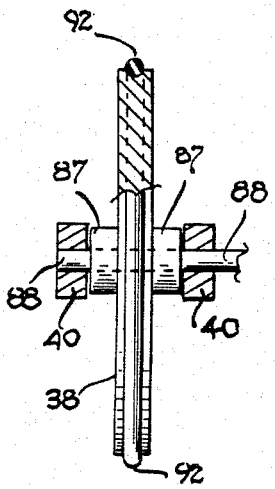
FIG. 5 is a sectional view taken generally along line 5—5 of FIG. 2, showing the power imparting wheel.
Figure 7:
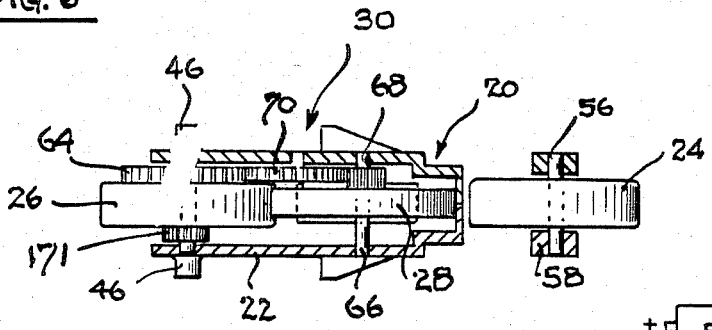
FIG. 7 is a sectional view taken generally along line 7—7 of FIG. 6.
Figure 8:
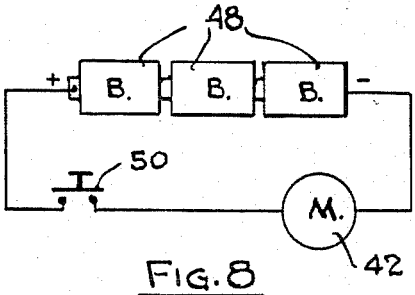
FIG. 8 is a schematic electrical diagram for the launcher.

In general, the illustrated toy motorcycle play apparatus comprises a toy motorcycle 20 as shown in FIGS. 6, 7 and *7a*, a motorized form of launcher 22 as shown in FIGS. 1–5 and 8, an alternative hand-powered form of launcher 122 as shown in FIGS. 9–12, and another alternative hand-powered form of launcher 222 as shown in FIGS. 14–17.

In general, the toy motorcycle 20 comprises a frame 22, a rotatable front wheel 24, a rotatable rear drive wheel 26, and a rotatable energy storing flywheel 28 positioned intermediate the front and rear wheels. The front and rear wheels and the flywheel are rotatable mounted on the frame 22 on horizontal, transversely extending axes, and they all lie in a vertical plane extending down the center of the toy motorcycle. The flywheel 28 is coupled to the rear drive wheel 26 by a gear train 30 which reduces speed while increasing power and duration of rotation at the rear wheel. Thus in operation, the flywheel 28 stores rotational energy and transmits it to the rear ground-engaging drive wheel 26 while also providing gyroscopic balance which maintains the motorcycle generally upright during its forward travel.

Figure 1:
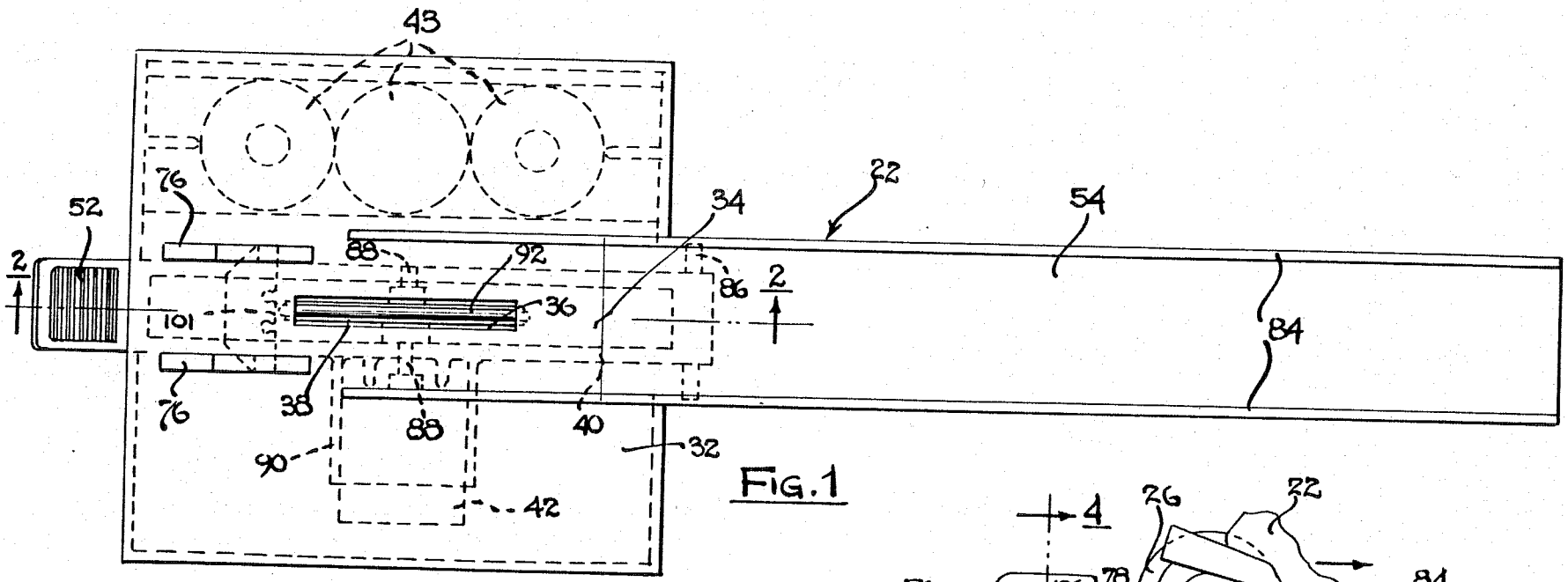
FIG. 1 is a plan view of a launcher of a toy motorcycle play apparatus which embodies the invention.
Figure 2:
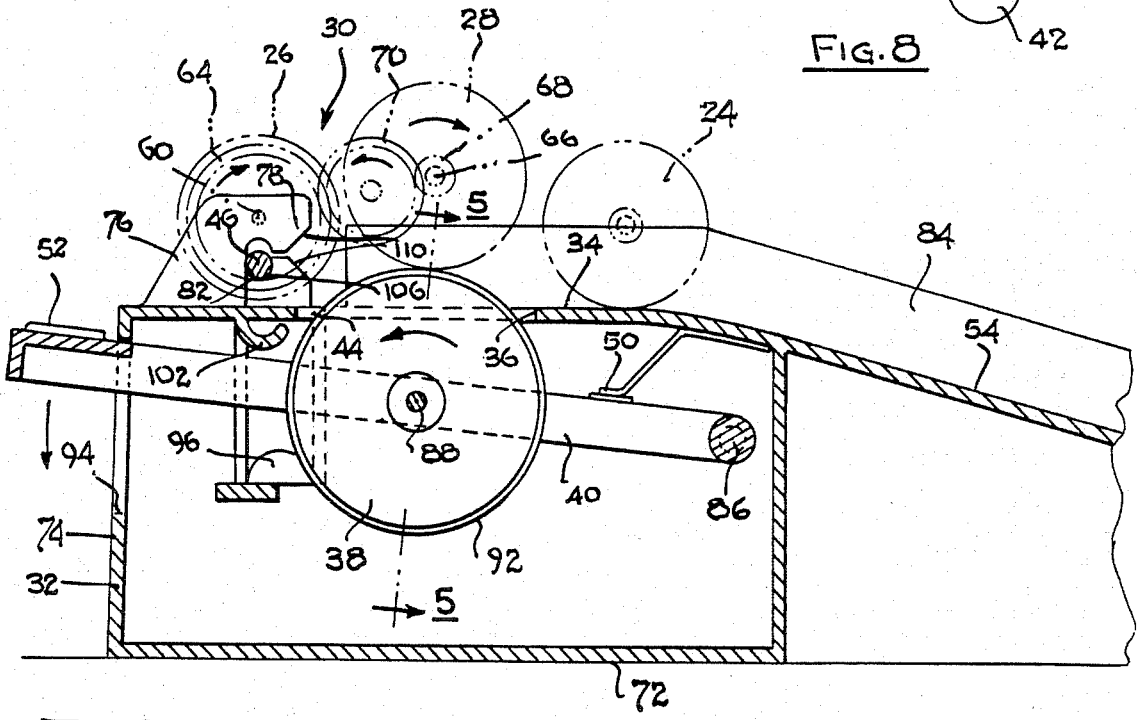
FIG. 2 is an enlarged side sectional view taken generally along line 2—2 of FIG. 1, showing in phantom certain elements of a toy motorcycle while it is mounted on the launcher and energy is being imparted to it.

The motor-powered launcher 22 illustrated in FIGS. 1–5 and 8, comprises generally a base or housing 32 having a top wall 34 that forms a launching platform on which the toy motorcycle 20 is releasibly held (as illustrated by phantom line representation in FIG. 2 of the front, rear and flywheels and the train gearing). In this position the motorcycle is supported and retained with its rear drive wheel 26 elevated off the platform 34, and with the flywheel 28 aligned with a longitudinally extending slot 36 in the platform. In this connection, a U-shaped support or yoke 44 has a pair of legs that support pins 46 fixed on opposite sides of the motorcycle rear end to lift the rear end of the motorcycle, restraining it from forward movement, and maintaining it in the desired upright orientation. An energy-imparting wheel or drum 38 is rotatably supported on a manually movable arm 40 in the housing 32 so that the upward edge of the drum 38 may be moved upwardly through the slot 36 to engage the edge of the flywheel 28 to transfer rotational motion and energy to the flywheel. The arm 40 also supports an electric motor 42 that drives the wheel 38. As the arm 40 moves upwardly toward the position shown in FIG. 2, but before the drum 38 engages the motorcycle flywheel 28, the movement of the arm closes a switch 50 which completes a circuit between the motor 42 and batteries 48 also mounted within the housing to energize the motor.

After the flywheel 28 is going fast enough, the user may manually lower the arm 40 to first disengage the wheel 38 from the flywheel 28 and next open the switch 50 to de-energize the motor 42. The arm 40 is coupled to the yoke 44 so that continued lowering of the arm also lowers the yoke 44 to lower rear drive wheel 26 of the motorcycle to the platform 34 and disengage the yoke from the side pins 46 so that the drive wheel can propel the motorcycle forwardly along the platform. The illustrated platform 34 has a forwardly and downwardly extending ramp 54 to contribute to the forward momentum of the motorcycle.

Figure 7A:
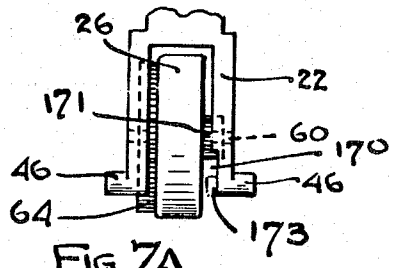
FIG. 7A is a rear end view of the toy motorcycle.

Now considering the illustrated apparatus in further detail, the toy motorcycle 20 is illustrated best in FIGS. 6, 7 and 7A. It comprises the generally upright frame 22. The forward wheel 24 is rotatably mounted on a transverse axle 56 between a bifurcated fork portion 58 at the forward end of the frame 22. Similarly rotatably mounted on a transverse shaft 60 between a bifurcated forked portion 62 at the rear of the frame, is the rear drive wheel 26. The rear drive wheel 26 is generally aligned with the forward wheel 24 and is substantially thicker than the slot 36 in the launcher platform. A gear 64 is carried at one side of the rear drive wheel 26. The flywheel 28 is rotatably supported on a transverse shaft 66 within the housing 22 and intermediate front and rear wheels and generally aligned with them. There is a small gear 68 mounted coaxially with the flywheel. An intermediate gear 70 is also rotatably mounted within the housing 22 and meshes with the small gear 68 on the flywheel and with the gear 64 on the rear drive wheel. Thus a power-transmitting train is provided between the rear drive wheel and the flywheel by the gears 68, 70, 64. The side pins 46 at the rear of the bifurcated rear frame portion extend outwardly to either side. The toy motorcycle simulates the appearance of a real motorcycle and rider, and may be made of various suitable materials such as molded plastic.

Now considering the illustrated launcher 22 in further detail, the housing or base 32 is a generally box-like structure having the top platform wall 34, a removable bottom wall 72 and four side walls 74. At the rear end of the platform, there are a pair of spaced-apart upwardly extending fingers 76, each having a forwardly and downwardly extending end portion 78 which defines a recess 80 which provides the upper portion of a receptacle for the side pins 46 of the motorcycle. The recesses 80 are in fixed positions, open downwardly, and have essentially semi-circular configurations. The forward edge 82 of each finger 76 extends downwardly from a recess 80 to provide a stop or abuttment for a motorcycle side pin 46. The fingers 76 are spaced apart sufficiently to receive the rear end of the toy motorcycle between them so that the side pins 46 are received in the receptacles as shown in FIG. 2. The elongated narrow slot 36 is disposed centrally of the platform 34 and starting just forwardly of the fingers 76. The platform 34 continues forwardly to the downwardly inclined elongated ramp 54. At either side of the platform 34 starting just forwardly of the fingers 76 and extending the full length of the ramp 54 at either side is an upstanding curb 84.

Figure 3:
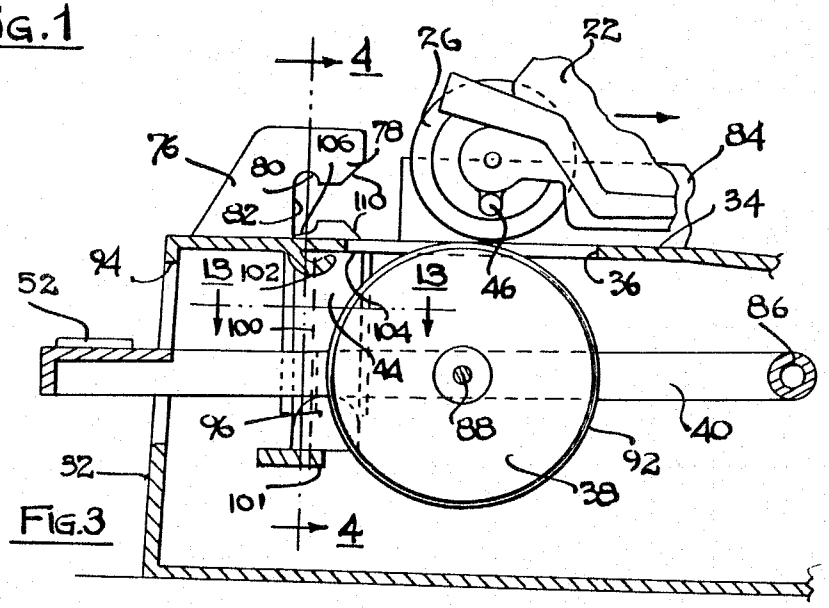
FIG. 3 is a view similar to FIG. 2, showing the relative parts shortly after the toy motorcycle has been released by the launcher.
Figure 4:
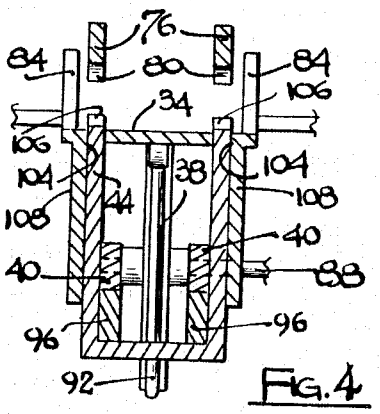
FIG. 4 is a sectional view taken generally along line 4—4 of FIG. 3.

The elongated bifurcated arm 40 is pivotally mounted at its forward end on a transverse shaft 86 supported between opposed upright walls of the ramp. The energy-imparting wheel 38 is rotatably supported on a shaft 88 between the bifurcated side portions of the arm 40 about midway between the ends of the arm. The wheel 38 has a spacing hub 87 at either side to maintain its properly spaced between the side portions of the arm 40. As seen in FIG. 1, one end of the shaft 88 continues to one side and is joined to or comprises an integral extension of the output shaft of the motor 42. As also shown in FIG. 1, the motor 42 is suitably mounted by support means 90 secured to the arm 40 for movement with the arm. The wheel 38 is aligned with the slot 36 in the platform so that the upper portion of the wheel 38 may pass through that slot as illustrated in FIG. 2. The wheel 38 has a rubber rim 92 to provide a high-friction contact surface for engaging and driving the motorcycle flywheel. An opening 93 in the bottom of the motorcycle frame provides access to the flywheel. The outer end of the arm 40 extends through a vertical slot 94 in the rear wall 74 of the housing and provides a manually depressible control handle 52 for the user. The arm 40 is also coupled to the generally U-shaped support or yoke 44; the upper ends of the legs of the yoke cooperate with the fingers 76 to support and retain the rear end of the toy motorcycle. More particularly, at the inside of the lower end of each leg of the yoke 44 there is a short cam block 96 having a curved upper surface for engaging one of the side portions of the arm 40. The yoke 44 is normally biased upwardly to a position such as shown in FIG. 2. The arm 40 will normally rest by virtue of its weight on the cam blocks 96 (this position of the arm 40 not shown in the drawings: the arm 40 is shown in FIG. 2 in a manually raised position to be explained below). When the arm 40 is manually depressed to a position such as shown in FIG. 3, the arm bears against the cam blocks 96 and thus depresses the upwardly biased yoke 44 to the position shown in that FIG. 3.

Figure 13:
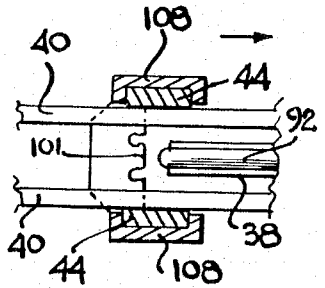
FIG. 13 is a sectional view taken generally along line 13—13 of FIG. 3.

As shown in FIG. 13, the yoke 44 is disposed for vertical reciprocating movement within an opposed pair of U-shaped guides 108 that depend from the underside of platform wall 34. The upper ends of the legs of the yoke 44 extend upwardly through openings 104 in the platform wall 34 and they are generally aligned with the stationary fingers 76. The upper ends of the yoke legs each have a curved cut-out or recess 106 which matches one of the upper recesses 80, for forming a receptacle that supports and restrains the side pins 46 on the toy motorcycle as shown in FIG. 2. A biasing means such as a spring or rubber band represented by the broken line 100 in FIG. 4 tends to urge the yoke 44 upwardly to the position of FIG. 2. The biasing means 100 may be secured between a tab 101 on the lower transverse portion of the yoke 44 and a tab 102 formed at the upper wall of the housing. Upward pivotal movement of the arm 40 may be limited as shown in FIG. 2 by its engagement with the upper end of slot 94.

To mount the toy motorcycle 20 on the launcher 22, the motorcycle may simply be disposed upright and centrally on the platform 34, and then pushed rearwardly so that the side pins 46 temporarily shift the biased yoke 44 downwardly to permit the pins to move partially past the yoke upper ends to where the pins are supported and retained by the upwardly biased yoke and the stationary fingers 76 (FIG. 2). This latching of the pins 46 is facilitated by forwardly facing cam surfaces 110 on the finger portions 78 and the yoke upper ends. At this time, the arm 40 will assume a position (not shown) by virtue of its weight where it rests upon the cam blocks 96 and the energy-imparting wheel 38 is out of contact with the motorcycle flywheel. When so mounted, the toy motorcycle as shown in FIG. 2 is supported with its rear drive wheel 26 off the platform 34 so that the drive wheel can rotate freely. The motorcycle is held by the side pins 46 being supported and retained in the receptacles 80, 106 formed by the stationary fingers 76 and the upwardly positioned yoke upper ends. When the arm 40 is in this position, the motor switch 50 is still open so the motor is off.

The user then grasps the control handle 52 of the arm 40 and lifts it upwardly. This first engages switch 50 to complete the circuit between the batteries 48 and the motor 42 to energize the motor to cause rotation of the wheel 38. As the arm continues upwardly, the edge of the now-rotating wheel 38 is urged against the edge of the motorcycle flywheel to impart rotation to the flywheel. It should be noted that the pivotal support of the motorcycle by the side pins 46 permits the portions of the motorcycle forwardly of the pins 46 (including the flywheel) to pivot counterclockwise as the wheel 38 applies upward force to the flywheel. Only the weight of the motorcycle maintains it urged against the wheel 38. This arrangement prevents the wheel 38 from being jammed against a rigidly supported flywheel and stalling the motor or breaking parts of the device.

When the flywheel is rotating rapidly enough, the user may then depress the arm 40 by pushing downwardly on the control handle 52. The arm first moves downwardly relative to the yoke 44 to first disengage the wheel 38 from the flywheel and to then open the switch 50 and shut off the motor. The yoke 44 is maintained in the upward position during this time by the action of the spring 100. As the arm 40 is pivoted further downwardly, it engages the cam blocks 96 on the yoke 44 to lower the yoke and thus release the motorcycle: the rear drive wheel 26 engages the platform 34 and propels the motorcycle forwardly along the platform and down the ramp 54. When the arm 40 is released, the spring 100 will return the yoke 44 to its raised position for the next launching.

The manually or hand-powered launcher 122 is illustrated in FIGS. 9–12. This launcher 122 comprises an elongated generally flat horizontal ramp 154 having an upright rear wall 155, and a pair of upright curbs or side walls 153. Centrally and longitudinally along the top of the launching ramp 154 a strip 157 of high-friction material may be secured. At the rear end of the ramp 154 there are a pair of fixed abutments in the form of spaced-apart upright support walls 159 having notches 161 in their forward ends, respectively. These notches 161 each define a stop surface at its rear end and a downwardly sloped lower edge. The notches 161 are proportioned and arranged to each receive one of the side pins 46 at the rear of the motorcycle. A slot 163 is also provided in the upper edge of the rear wall 155 of the launcher for a T-rack 165 to extend through. The launcher 122 may also include a handle 167 at one side of its rear end.

Figure 9:
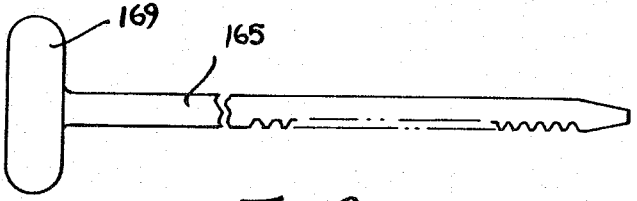
FIG. 9 illustrates an elongated flexible T-rack for use with a modified embodiment of the apparatus.
Figure 10:
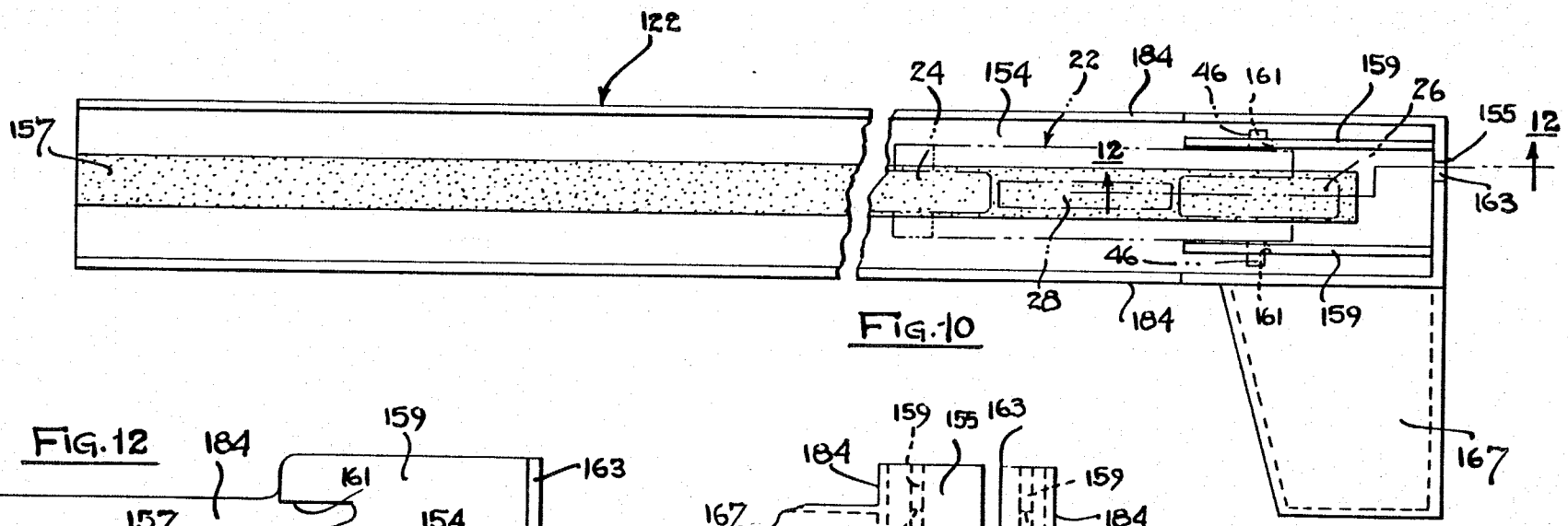
FIG. 10 is a plan view of a modified form of launching apparatus.
Figure 11:
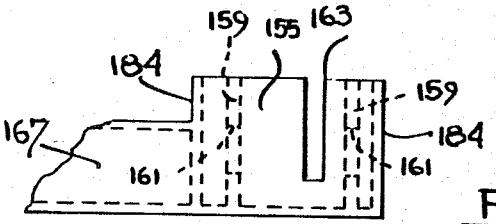
FIG. 11 is a rear end view of the apparatus of FIG. 10.
Figure 12:
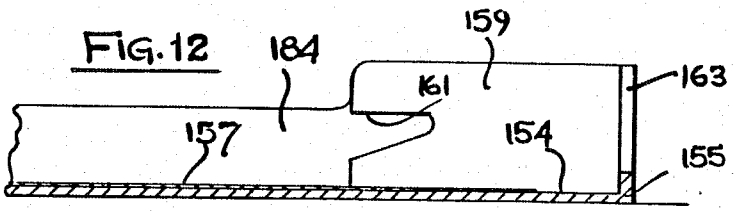
FIG. 12 is a sectional view taken generally along line 12—12 of FIG. 10.

FIG. 9 shows a conventional energy-imparting T-shaped pull rack 165 which has a pull handle 169 and may be formed of any suitable material such as flexible plastic or hard rubber. FIG. 7A shows a guide 173 which defines a space or opening at the rear of the toy motorcycle adjacent a gear 171 on the rear drive wheel axle 60 opposite gear 64. The forward end of the pull rack 165 may be inserted through the opening 170 and push forwardly; the rack meshes with the gear 171 and is held against it by the guide 173; the drive train simply rotates until the rack is fully inserted in the forward direction. With the rack thus in the ready position in the toy motorcycle, the motorcycle may be positioned on the launcher 122 with the side pins 46 in the slots 161 and the rear end of pull rack 165 extending through the vertical slot 163 to position its handle 169 rearwardly of the launcher rear wall 155. To launch the toy motorcycle 20 from the launcher 122, the user simply holds the launcher handle 167 with one hand and grasps and pulls rearwardly on the rack handle 169 with the other hand. Rearward movement of the rack 165 will initially draw the side pins 46 of the motorcycle to the stop surfaces at the rear ends of the slots 161. By virtue of the location and configuration of the slots 161 the rear drive wheel 26 will be lifted off the ramp 154 and will be free to rotate. Continued rearward movement of the rack 165 imparts rotation to the gear 171 on the drive wheel thus to the entire gear train and flywheel 28 of the toy motorcycle. When the rack has completely passed and disengaged from the gear 171 on the motorcycle drive wheel, the motorcycle drive train will be rotating rapidly and the motorcycle, by virtue of its weight and the reaction to the release of the rack, will move down the inclined lower edges of the slots 161 until the drive wheel engages the ramp. As noted above, rotational energy is stored in the flywheel and is transmitted by the speed reducing but power and duration increasing gear train to the rear drive wheel. Flywheel also acts to maintain the toy motorcycle upright by gyroscopic action as it moves forwardly.

It will be apparent that the pull rack 165 may also be used with the illustrated toy motorcycle without the launcher. The user may simply hold the motorcycle in one hand and the rack in the other, insert the rack forwardly into the opening 170 to the forward ready position, and pull the rack rearwardly to impart rotation to the motorcycle drive-train mechanism. As soon as the rack releases and is disengaged from the motorcycle, the motorcycle may be placed upon the ground or forward movement.

Figure 17:
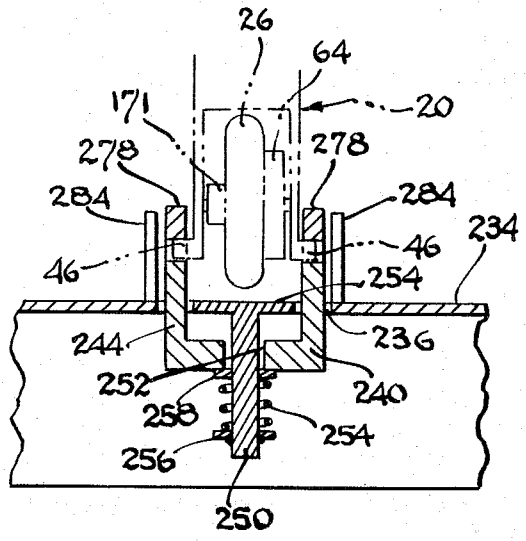
FIG. 17 is a transverse sectional view taken generally along line 17—17 of FIG. 14.
Figure 14:
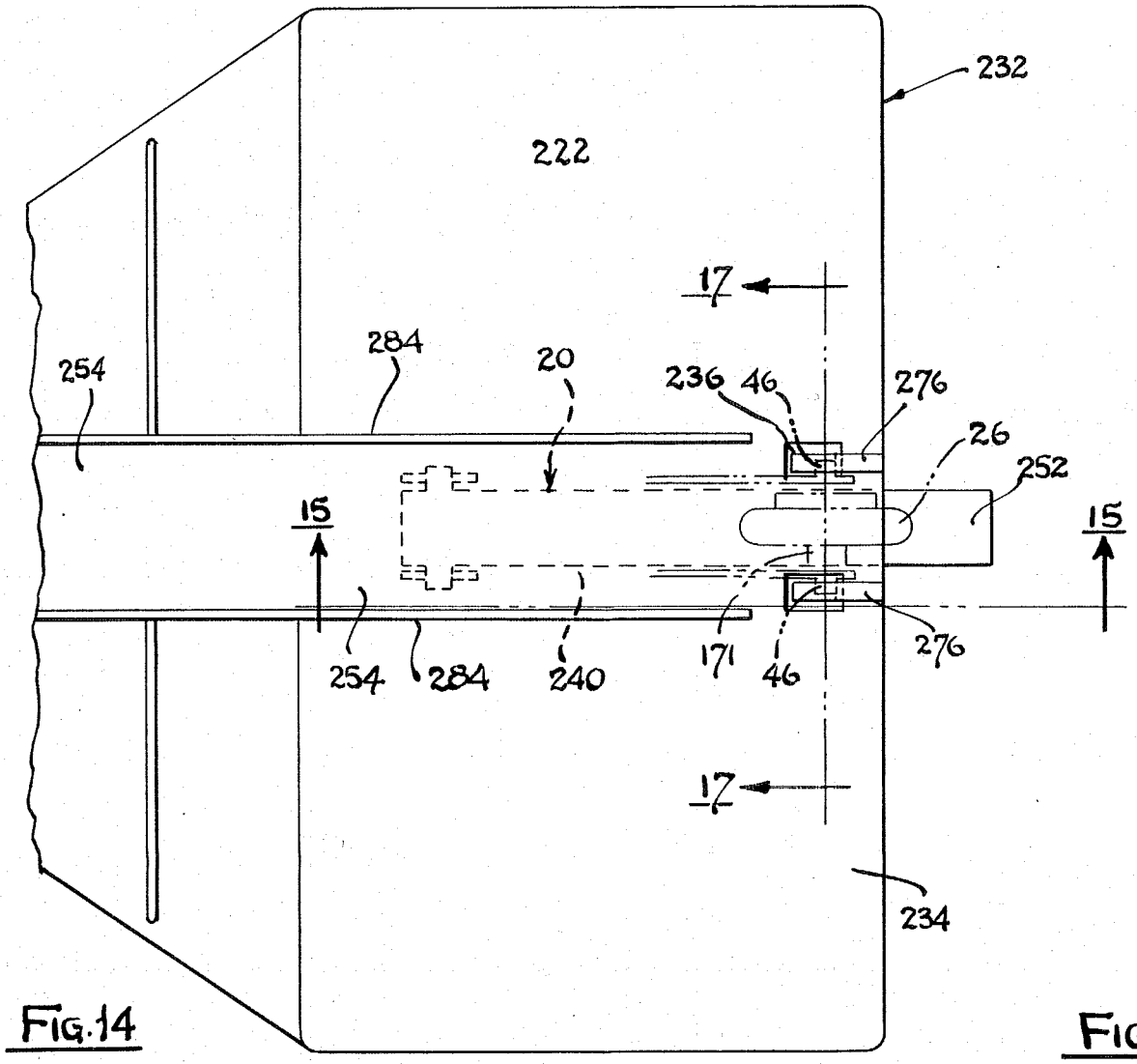
FIG. 14 is a top plan view (partially broken off) of another modified embodiment of manually operable launcher.
Figure 15:
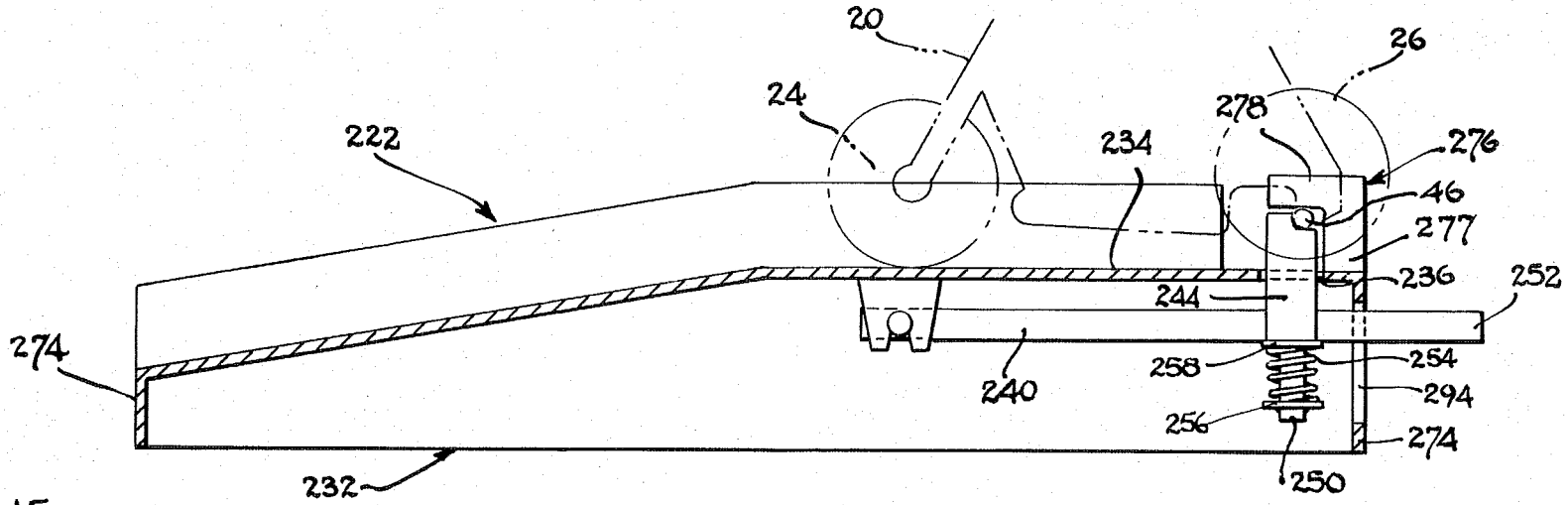
FIG. 15 is a longitudinal sectional view taken generally along line 15—15 of FIG. 14.
Figure 16:
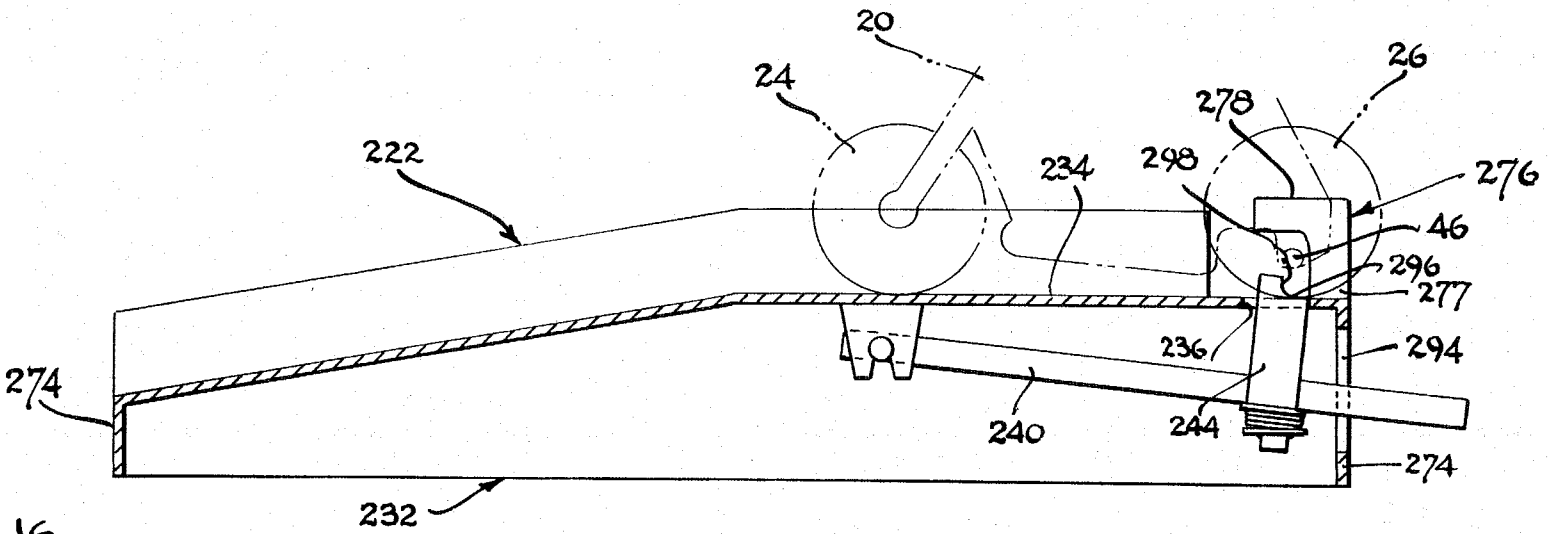
FIG. 16 is a view similar to FIG. 15, but shows the motorcycle in its lowered, released position.

Another manually or hand-powered launcher 222 is illustrated in FIGS. 14 through 17. The launcher 222 accommodates the toy motorcycle and rider 20 in the position shown in broken line in the drawings. FIGS. 14, 15 and 17 show the toy motorcycle 20 supported with its rear drive wheel 26 elevated above the upper surface of the platform 234 and restrained from forward movement. FIG. 16 shows the toy motorcycle 20 with the rear wheel 26 in its lowered and driving position upon the upper surface of the platform 234

In general the launcher 222 comprises a box-like frame or housing 232, which provides the upper wall or platform 234 on which the toy motorcycle 20 is releasibly supported. The housing 232 supports spring biased holding means for supporting and retaining the toy motorcycle 20 in the generally upright position shown in FIGS. 15 and 17, with the rear drive wheel 26 elevated above the surface of the platform 234. While the toy motorcycle is held in this position, rotation is imparted to the rear wheel 26 and the flywheel 28 through the gear train by virtue of a pull rack such as the one designated 165 in FIG. 9. The construction of the toy motorcycle 20 to accommodate the pull rack 165 is illustrated best in FIG. 7A. More particularly, the pull rack 165 extends through the space 170 defined between the small gear 171 coaxially fixed to the rear wheel 26, and a projection 173 extending from an adjacent portion of the motorcycle frame. With the motorcycle held in place on the launcher 222 as noted above, the pull rack 165 is pulled rearwardly by its handle 169 to impart rapid rotation to the gear 171, and thus to the rear wheel 26, the gear train 64, 70, 68 and the flywheel 28. As noted above the rear drive wheel 26 is elevated out of contact with the surface of the platform 234 so that the wheel 26 can rotate freely. The motorcycle may then be released at the moment selected by the user by operation of the holding and support means. This will release the motorcycle and allow the rear wheel 26 to engage the surface of the platform 234 to thereby propel the toy motorcycle forwardly and off the platform.

More particularly, the illustrated launcher 222 comprises the generally box-like housing 232 which has top wall 234, a rear wall, a front wall, and a pair of opposed side walls 274. As will be seen from the drawings, the housing 234 has a rearward portion where the top wall is generally level and a forward portion where the top wall inclines downwardly in the forward direction. Dispose generally centrally side-to-side on the top wall 234 is a front to back pathway or ramp 254 defined by a pair of opposed upright guide rails or walls 284. The rearward housing section extends a substantial distance to either side of the ramp 254. This provides stability to the housing 232 and further provides a convenient place for the user to place one hand to hold the launcher while a pull rack is being pulled with the other hand. The forward section housing is also tapered inwardly toward the front as shown in FIG. 14. Transverse reinforcing ribs may also be provided as shown in that figure. The housing 232 may also have a bottom wall (not shown) if desired. The starting position of the toy motorcycle 20 on the launcher 222 is shown best in FIG. 15. The rear wheel 26 of the motorcycle extends slightly rearwardly of the rear end of the launcher and is elevated above the surface of the platform 234, while the front wheel 24 rests upon that surface. Toy motorcycle is about the length of the rear section of the launcher so that the front wheel 24 is resting upon the level portion of the upper wall 234.

The means for supporting and retaining the toy motorcycle comprise fixed means mounted on the upper wall 234 of the housing at its rear end, and movable means that are biased upwardly and cooperate with the fixed means so to capture connection means mounted on the frame of the toy motorcycle. More particularly, the toy motorcycle 20 has the outwardly extending projections 46 on the rear portion of the frame adjacent the rear wheel. The illustrated projections 46 are shown positioned generally below the axle of the rear wheel and spaced intermediate that axle and the outer periphery of the rear wheel. The fixed portion of the holding means comprises a pair of L-shaped fingers 276 each having one section 277 secured to the rear end of the upper wall 234 and extending upwardly. A second section 278 of each of these fixed fingers 276 then extends forwardly from the upper end of the first section. The fixed fingers 276 are generally spaced apart by a distance slightly greater than the width of the toy motorcycle 20 as shown best in FIGS. 14 and 17. In this way the rear end of the motorcycle is disposed between the fixed fingers 276 and the outward projections 46 are positioned to engage a downwardly directed surface 280 and a forwardly directed surface 282 of each of the fixed fingers. The fixed fingers may be integrally formed with the housing in the form of a single molded plastic part. The movable holding means comprises a pair of upwardly extending fingers 244 which are generally aligned respectively with the fixed fingers 276 as shown best in FIG. 17. Each of the movable fingers 244 has a notch in the rear portion of its upper end to define an upwardly directed surface 296 and rearwardly directed surface 298. With the movable sections in position as shown in FIGS. 15 and 17, each set of the downwardly directed, forwardly directed, upwardly directed, and rearwardly directed surfaces 280, 282, 296, 298 form a confining enclosure for the respective projection 46 at its side of the motorcycle. The movable fingers 244 are secured at their lower ends to an arm 240 pivotally mounted in the housing 232. The movable fingers 244 extend upwardly through respective openings 236 in the top wall 234. The arm 240 is pivotly mounted at its forward end to the underside of the housing wall 234 for pivotal movement about a transverse generally horizontal axis. The rear end of the lever extends through elongated vertical slot 294 in the rear wall of the housing to provide a handle 252 for the user. The rearward end of the arm 240 is biased upwardly to the position shown in FIGS. 15 and 17. An elongated pin 250 is secured to the underside of the housing top wall 234 as shown in FIG. 17, and the pin extends through an opening 252 in the arm. A spiral spring 254 is disposed on the pin 250 below the arm and supported by any suitable means such as a wash 256 fixed to the lower end of the pin 250. A second washer 258 may be positioned on the pin 250 above the spring 254. In this way the spring 254 urges the arm 240 to the position shown in FIGS. 15 and 17 to thereby position the movable fingers 244 in the raised position shown in those FIGS. 15 and 17. When the user manually depresses the lever arm 240 against the spring to the position such as shown in FIG. 16, the movable fingers 244 are lowered to the position shown in that FIG. 16.

With the motorcycle secured by the holding means in the position shown in FIG. 15 and 17, the pull rack is drawn rearwardly to impart rapid rotation to the drive train including the rear drive wheel and the flywheel of the motorcycle. Then when the user desires he or she pushes downwardly on the end of the pivoted lever arm to 240 lower the movable fingers 244. This disengages the movable fingers from the projections 46 and allows the rear wheel of the motorcycle to engage the surface of the platform wall 234 (as shown in FIG. 16). Rotation of the rear wheel 26 will then drive the motorcycle forwardly along the surface of the platform 234, down the incline ramp 254 and onto the adjacent supporting surface. The movement of the motorcycle along the pathway is assisted and guided by the side rails 284 to give the motorcycle a good start in an upright position. The motorcycle is also maintained in its upright position by the gyroscopic action of the flywheel.

Various modifications and changes may be made in the illustrated structure without departing from the spirit and scope of the present invention. While the illustrated motorcycle toy is advantageously used in combination with the illustrated launchers, each of the launchers might advantageously be used with somewhat different construction or configuration motorcycle or toy vehicle. Similarly, the launchers could themselves be modified in various respects as desired. By way of example, the motor might be powered by means of an electrical cord which plugs into a wall socket rather than by use of batteries. Similarly, the energy-imparting wheel might be hand-powered. Further, while it is advantageous to mount the motor on the same arm which carries the energy-imparting wheel, the motor means could be stationarily mounted and coupled to the energy-imparting wheel as by means of a drive-belt arrangement. The details of the structure for elevating, retaining and releasing the toy motorcycle may also be modified. In this connection, by way of example, the location of the projections on the motorcycle and the recepticles or slots on the launchers could essentially be reversed. It would also be possible to couple the movement of the arm and the energy-imparting wheel and the turning off and on of the motor to the mounting or latching of the vehicle onto the launcher, so that the motor was turned on and brought into contact with the vehicle flywheel automatically when the vehicle was mounted on the launcher. Mechanism could also be provided for automatically releasing the motorcycle after a certain amount of time or a certain amount of rotational speed had been obtained. The details of the hand-powered launcher could also be modified, as for example, by using a pull string instead of a toothed rack. While such and other modifications are within the contemplated scope of the present invention, the illustrated embodiments are the presently preferred forms of the invention and provide improved, simple and effective devices to accomplish the intended purposes and objectives, considering such things as cost of manufacture and assembly, ease of operation and simplicity as well as durability. The precise scope of the invention is as set forth in the following claims.

What is claimed is:

1. Toy vehicle play apparatus comprising:

(a) a wheeled toy vehicle having:

a frame, connection means including a projection fixed on the frame, at each side of the toy vehicle, and at least one ground-engaging drive wheel rotatably mounted on the frame;

(b) a launcher having:

a platform, control means for releasably supporting and holding the vehicle on the platform with the drive wheel out of engagement with the platform so that the drive wheel can rotate freely, for imparting rotation to said drive wheel, and for releasing the vehicle and allowing the drive wheel to engage the platform to propel the vehicle forwardly, the control means comprising fixed abutment means on the platform defining at least one forwardly facing reaction surface, the abutment means comprising a spaced-apart pair of abutment members each engageable with one of the projections of the vehicle connection means, the control means further comprising generally vertically movable retaining means on the platform, at each side of the toy vehicle when the toy vehicle is held on the platform, for engaging the respective projections of the vehicle connection means to elevate the drive wheel out of engagement with the platform and to support and hold the vehicle while rotation is being imparted to the drive wheel, said movable retaining means comprising a pair of fingers each aligned with one of said abutment members, each associated pair of said fingers and of said abutment members being arranged and configured to cooperatively support and hold one of said projections, the control means also comprising hand-movable rotation-imparting means engageable with the vehicle energy-storing drive mechanism and operable to urge the toy vehicle rearwardly against the reaction surface while imparting rotation to said mechanism, the movable retaining means being separately and selectively manually operable to disengage from the connection means on the vehicle and allow the rotating drive wheel to engage the platform for launching of the toy vehicle.

2. The play apparatus of claim 1 wherein said movable retaining means extend upwardly through an opening through said platform.

3. The play apparatus of claim 2 wherein retaining means are carried on an elongated arm movably mounted on the launcher.

4. The play apparatus of claim 3 wherein said arm is biased upwardly.

5. The play apparatus of claim 4 wherein said arm is pivotally mounted on said launcher.

6. The play apparatus of claim 1 wherein said hand movable rotation-imparting means is in the form of a hand-pullable separate member which engages with said energy-storing drive mechanism on the toy vehicle while energy is being transferred, and which then disengages from said mechanism.

7. The play apparatus of claim 6 wherein the launcher includes an enlarged portion extending to at least one side which the user can place his or her hand upon to stabilize the launcher when the separate member is pulled.

8. Toy motorcycle play apparatus comprising:

(a) a two-wheeled toy motorcycle having:

a frame, and dual connection means fixed on opposite sides of the frame and comprising an outwardly extending projection at each side of said motorcycle, generally aligned rotatable front and rear ground-engaging wheels mounted on the frame and rotatable about generally horizontal transverse axes, one of the wheels being a drive wheel, a flywheel intermediate to the wheels and also mounted on the frame and rotatable about a generally horizontal transverse axis, the flywheel and the drive wheel being operatively coupled together by a gear train which reduces the speed and increases the power and duration of rotation of the drive wheel, the flywheel, gear train and the drive wheel composing an energy-storing drive-train mechanism, and the toy motorcycle, when in operation, being powered and gyroscopically balanced by the flywheel;

(b) a launcher having:

a platform, control means for releasably supporting and holding the motorcycle on the platform in an upright forwardly aligned position with its drive wheel out of engagement with the platform so that the drive wheel can rotate freely, for imparting rotation to the flywheel, and for releasing the motorcycle and allowing the rotating drive wheel to engage the platform to propel the motorcycle forwardly, the control means comprising a vertically manually movable section movable between an upper and a lower position, the movable section comprising a pair of movable-section legs disposed at opposite sides of the motorcycle and engaging one of the projections respectively, when the motorcycle is mounted on the launcher and the movable sections are in the raised position, the movable-section legs engaging, when in the upper position, the fixed connection means on the motorcycle frame so as to elevate the drive wheel out of engagement with the platform, and so as to maintain the motorcycle in its upright position and prevent its forward movement while rotation is being imparted to the flywheel, and the movable section allowing, when moved toward its lower position, the motorcycle drive wheel to engage the platform and the motorcycle to move forwardly.

9. The play apparatus of claim 8 wherein:

each of said movable-section legs cooperates with a stationary support section of the control means to hold the motorcycle in place when the movable section is in its raised position, said stationary support sections being fixed mounted on said launcher.

10. The play apparatus of claim 9 wherein said projections are pivotally supported by said movable section legs.

11. The play apparatus of claim 10 wherein each of said movable-section legs extends upwardly through an opening in the platform.

12. The play apparatus of claim 11 wherein said movable-section legs are biased toward the upper position.

13. The play apparatus of claim 12 where said movable-section legs are coupled to a movable lever mounted on the frame, the lever having a manually graspable portion for moving the lever so as to move the movable-section legs away from the upper position.

14. The play apparatus of claim 9 wherein said controlling means comprise manually actuated rotation-imparting means in the form of a hand pullable separate member which engages with said energy-storing drive train mechanism on the toy motorcycle while energy is being transferred, and which then disengages from said mechanism.

15. The play apparatus of claim 14 wherein said pull member comprises an elongated toothed rack having an enlarged handle at its rear end, and said motorcycle is provided with guide means for receiving the rack in engagement with the motorcycle gear train for generally front-to-back longitudinal movement while meshed with said gear train.

16. The play apparatus of claim 15 wherein said gear train includes a gear coaxial with and fixed for common rotation with said motorcycle drive wheel, said gear being engagable with said rack.

17. The play apparatus of claim 8 wherein the launcher has a spaced-apart pair of side rails defining a launching ramp for the toy motorcycle.

* * * * *